US006532667B1

(12) United States Patent
Leaseburge

(10) Patent No.: US 6,532,667 B1
(45) Date of Patent: Mar. 18, 2003

(54) REPLACEABLE LUBRICATING DEVICE FOR A RAZOR

(76) Inventor: Emory L. Leaseburge, 1146 12th, Huntington, WV (US) 25701

( * ) Notice: Subject to any disclaimer, the term of this patent is extended or adjusted under 35 U.S.C. 154(b) by 234 days.

(21) Appl. No.: 09/627,476

(22) Filed: Jul. 28, 2000

(51) Int. Cl.[7] ..... B26B 21/40; B26B 19/40
(52) U.S. Cl. ..... 30/41; 30/538
(58) Field of Search ..... 30/32, 41, 34.05, 30/526, 537, 538, 539, 84

(56) References Cited

U.S. PATENT DOCUMENTS 3,232,785 A * 2/1966 Smith ..... 428/353
3,869,393 A * 3/1975 Booker ..... 508/167
3,895,437 A * 7/1975 DiBuono ..... 15/244.2
4,170,821 A * 10/1979 Booth ..... 30/41
4,268,958 A * 5/1981 Hilbert ..... 30/41.7
4,546,544 A * 10/1985 Kiraly et al. ..... 30/47
4,683,096 A 7/1987 Ferraro
4,697,342 A * 10/1987 Ferraro ..... 30/41
4,705,715 A * 11/1987 DeCoste et al. ..... 442/151
4,850,106 A * 7/1989 Braun et al. ..... 30/41
4,872,263 A 10/1989 Etheredge, III
4,875,287 A * 10/1989 Creasy et al. ..... 30/34.05
5,019,064 A * 5/1991 Eilender ..... 604/378
5,036,587 A 8/1991 Trotta et al.
5,388,331 A * 2/1995 Doroodian-Shoja Siamak .. 116/208
5,603,691 A * 2/1997 Scholz et al. ..... 602/8
5,653,971 A 8/1997 Badin et al.
D401,014 S 11/1998 Tseng et al.
5,915,791 A * 6/1999 Yin et al. ..... 30/41
6,185,822 B1 * 2/2001 Tseng et al. ..... 30/41
6,295,733 B1 * 10/2001 Wexler et al. ..... 30/41
6,301,785 B1 * 10/2001 Kwiecien et al. ..... 30/41

* cited by examiner

*Primary Examiner*—Boyer D. Ashley

(57) ABSTRACT

A replaceable lubricating device for a razor for lubricating, soothing and medicating the user's face while shaving. The replaceable lubricating device for a razor includes a strip of material having a first layer and a second layer having adhesive disposed thereon with the strip of material being adapted to be removably attached upon a head member of a manual razor adjacent to and behind an opening through which razor blades are disposed; and also includes a lubricating substance disposed within the strip of material for lubricating a user's face during shaving; and further includes a protective cover being removably attached to the second layer for protecting the adhesive.

8 Claims, 2 Drawing Sheets

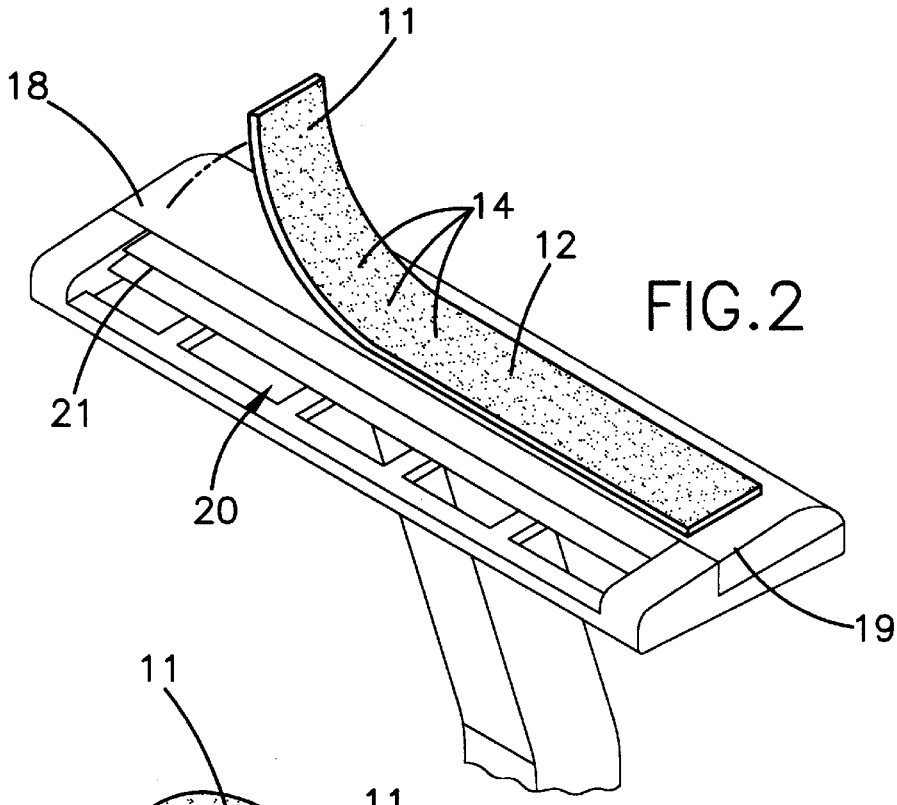
FIG.2
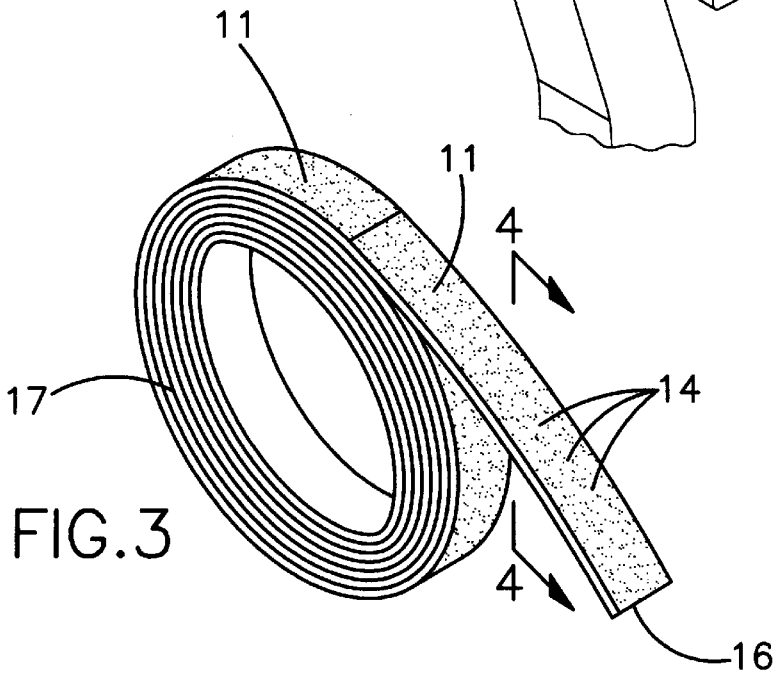
FIG.3
FIG.4
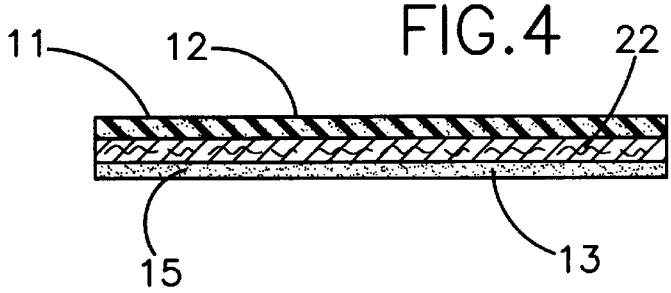

REPLACEABLE LUBRICATING DEVICE FOR A RAZOR

BACKGROUND OF THE INVENTION

1. Field of the Invention

The present invention relates to a lubricating strip of material and more particularly pertains to a new replaceable lubricating device for a razor for lubricating, soothing and medicating the user's face while shaving.

2. Description of the Prior Art

The use of a lubricating strip of material is known in the prior art. More specifically, a lubricating strip of material heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,683,096; 5,036,587; 4,697,342; 4,872,263; 5,653,971; and U.S. Pat. No. Des. 401,014.

While these devices fulfill their respective, particular objectives and requirements, the aforementioned patents do not disclose a new replaceable lubricating device for a razor. The inventive device includes a strip of material having a first layer and a second layer having adhesive disposed thereon with the strip of material being adapted to be removably attached upon a head member of a manual razor adjacent to and behind an opening through which razor blades are disposed; and also includes a lubricating substance disposed within the strip of material for lubricating a user's face during shaving; and further includes a protective cover being removably attached to the second layer for protecting the adhesive.

In these respects, the replaceable lubricating device for a razor according to the present invention substantially departs from the conventional concepts and designs of the prior art, and in so doing provides an apparatus primarily developed for the purpose of lubricating, soothing and medicating the user's face while shaving.

SUMMARY OF THE INVENTION

In view of the foregoing disadvantages inherent in the known types of lubricating strip of material now present in the prior art, the present invention provides a new replaceable lubricating device for a razor construction wherein the same can be utilized for lubricating, soothing and medicating the user's face while shaving.

The general purpose of the present invention, which will be described subsequently in greater detail, is to provide a new replaceable lubricating device for a razor which has many of the advantages of the lubricating strip of material mentioned heretofore and many novel features that result in a new replaceable lubricating device for a razor which is not anticipated, rendered obvious, suggested, or even implied by any of the prior art lubricating strip of material, either alone or in any combination thereof.

To attain this, the present invention generally comprises a strip of material having a first layer and a second layer having adhesive disposed thereon with the strip of material being adapted to be removably attached upon a head member of a manual razor adjacent to and behind an opening through which razor blades are disposed; and also includes a lubricating substance disposed within the strip of material for lubricating a user's face during shaving; and further includes a protective cover being removably attached to the second layer for protecting the adhesive.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new replaceable lubricating device for a razor which has many of the advantages of the lubricating strip of material mentioned heretofore and many novel features that result in a new replaceable lubricating device for a razor which is not anticipated, rendered obvious, suggested, or even implied by any of the prior art lubricating strip of material, either alone or in any combination thereof.

It is another object of the present invention to provide a new replaceable lubricating device for a razor which may be easily and efficiently manufactured and marketed.

It is a further object of the present invention to provide a new replaceable lubricating device for a razor which is of a durable and reliable construction.

An even further object of the present invention is to provide a new replaceable lubricating device for a razor which is susceptible of a low cost of manufacture with regard to both materials and labor, and which accordingly is then susceptible of low prices of sale to the consuming public, thereby making such replaceable lubricating device for a razor economically available to the buying public.

Still yet another object of the present invention is to provide a new replaceable lubricating device for a razor which provides in the apparatuses and methods of the prior art some of the advantages thereof, while simultaneously overcoming some of the disadvantages normally associated therewith.

Still another object of the present invention is to provide a new replaceable lubricating device for a razor for lubricating, soothing and medicating the user's face while shaving.

Yet another object of the present invention is to provide a new replaceable lubricating device for a razor which includes a strip of material having a first layer and a second layer having adhesive disposed thereon with the strip of material being adapted to be removably attached upon a head member of a manual razor adjacent to and behind an opening through which razor blades are disposed; and also includes a lubricating substance disposed within the strip of material for lubricating a user's face during shaving; and further includes a protective cover being removably attached to the second layer for protecting the adhesive.

Still yet another object of the present invention is to provide a new replaceable lubricating device for a razor that gives the user a smoother and closer shave.

Even still another object of the present invention is to provide a new replaceable lubricating device for a razor that prevents skin irritations, rashes, and painful nicks and cuts.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of the present invention shown being attached to the head member of the razor.

FIG. 3 is a perspective view of the present invention being connected end-to-end with other strips of material.

FIG. 4 is a cross-sectional view of the present invention.

DESCRIPTION OF THE PREFERRED EMBODIMENT

Figure 1:
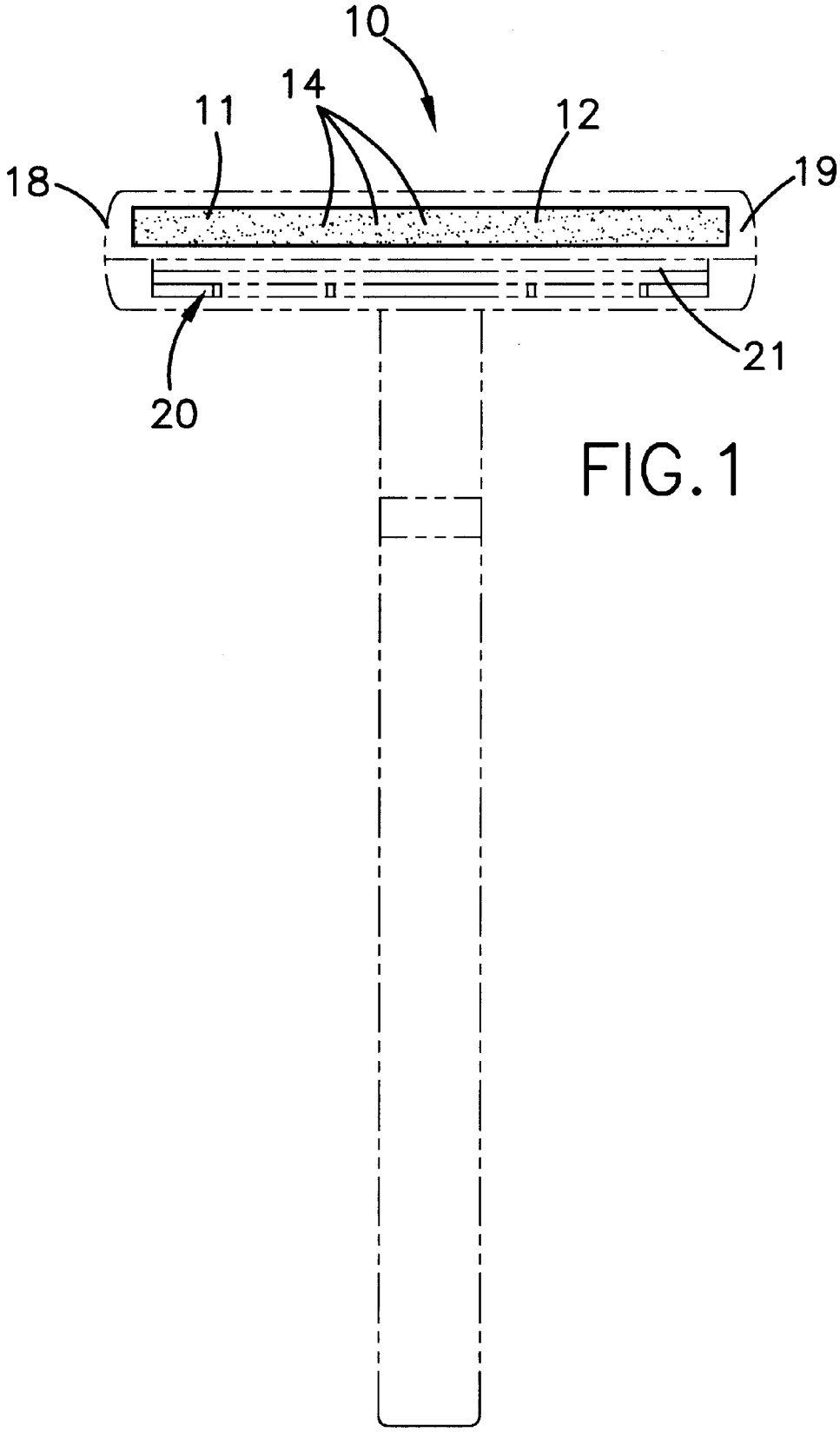
FIG. 1 is a side elevational view of a new replaceable lubricating device for a razor according to the present invention shown being attached to a razor.

With reference now to the drawings, and in particular to FIGS. 1 through 4 thereof, a new replaceable lubricating device for a razor embodying the principles and concepts of the present invention and generally designated by the reference numeral 10 will be described.

As best illustrated in FIGS. 1 through 4, the replaceable lubricating device for a razor 10 generally comprises a strip of material 11 having a first layer 12 and a second layer 13 having adhesive 15 disposed thereon with the strip of material 11 being adapted to be removably attached upon a head member 18 of a manual razor 19 adjacent to and behind an opening 20 through which razor blades 21 are disposed. The strip of material 11 is adapted to extend a length of the opening 20 in the head member 18 of the razor 19. The first layer 12 includes a plurality of pores 14 being spaced thereabout and extending therethrough with the strip of material 11 having a length of approximately 1½ inches and a thickness of approximately ⅛ inch. The strip of material 11 is detachably attached end-to-end with other like strips of material 11 and is wound into a roll 17.

A lubricating substance 22 is conventionally disposed within the strip of material 11 for lubricating a user's face during shaving. The lubricating substance 22 is adapted to ooze through the pores 14 of the first layer 12 upon the user moving the strip of material 11 upon the user's face with the lubricating substance 14 being a medicating substance in liquid form. A protective cover 16 is removably attached to the second layer 13 for protecting the adhesive 15.

In use, the razor 19 should have a relatively flat outer surface upon the head member 18 next to where the opening 20 is located for disposing the blades 21. The user would remove a strip of material 11 from the roll 17 and remove the protective cover 16 from the second layer 13 and attach the strip of material 11 upon the flat outer surface of the razor 19. As the user moves the razor 19 upon one's face during shaving, the strip of material 11 is urged against the user's face which causes the lubricating substance 22 to ooze through the pores 14 in the first layer 12 and upon the user's face while shaving to essentially soothe one's face.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shaving system of the wet shave type comprising:

a manual razor having a cutting head member and a handle member;

a roll of a plurality of flexible elongated strips of material having a first layer and a second layer, said second layer having an adhesive disposed thereon, each of said strips of material in said roll removably attachable to the cutting head member of the manual razor adjacent to and behind an opening through which razor blades are disposed;

a lubricating substance disposed within each of said strips of material for lubricating a user's face during shaving; and a protective cover being removably attached to the adhesive on said second layer for protecting said adhesive until said protective cover is removed by the user prior to attaching to said head member of said manual razor.

2. A replaceable lubricating device for a razor as described in claim 1, wherein the strip of material is adapted to extend a length of the opening in the head member of the razor.

3. A replaceable lubricating device for a razor as described in claim 1, wherein the first layer includes a plurality of pores being spaced thereabout and extending therethrough.

4. A replaceable lubricating device for a razor as described in claim 3, wherein the lubricating substance oozes through said pores of said first layer upon the user moving said strip of material upon the user's face.

5. A replaceable lubricating device for a razor as described in claim 1, wherein said lubricating substance is a medicating substance.

6. A replaceable lubricating device for a razor as described in claim 1, wherein said strip of material has a length of approximately 1½ inches and a thickness of approximately ⅛ inch.

7. A replaceable lubricating device for a razor as described in claim 1, wherein said strip of material is detachably attached end-to-end with other said strips of material wound into a roll to facilitate ease of use and compact storage of said strips prior to use.

8. A shaving system of the wet shave type comprising:

a manual razor having a cutting head member and a handle member;

a roll of a plurality of flexible elongated strips of material having a first layer and a second layer, said second layer having an adhesive disposed thereon, each of said strips of material in said roll removably attachable to the cutting head member of the manual razor adjacent to and behind an opening through which razor blades are disposed, each of said strips of material being adapted to extend a length of the opening in the head member of the manual razor, said first layer including a plurality of pores being spaced thereabout and extending therethrough, each of said strips of material having a length of approximately 1½ inches (3.81 cm) and a thickness of approximately ⅛ inch (0.3175 cm), each of said strips of material being detachably attached end to end with each other and being wound into said roll to facilitate ease of use and compact storage of said strips prior to use;

a lubricating substance disposed within each of said strips of material for lubricating a user's face during shaving, said lubricating substance being adapted to ooze through said pores of said first layer upon the user moving said strip of material attached to said cutting head member of said razor upon the user's face, said lubricating substance being a medicating substance in liquid form; and a protective cover being removably attached to the adhesive on said second layer for protecting said adhesive until said protective cover is removed by the user prior to attaching to said head member of said manual razor.

* * * * *